US008387503B2

(12) United States Patent
Lesage et al.

(10) Patent No.: US 8,387,503 B2
(45) Date of Patent: Mar. 5, 2013

(54) PYROTECHNIC DEVICE FOR DESTROYING AMMUNITIONS

(75) Inventors: Martine Lesage, Loury (FR); Gilles Boucheron, Clery St Andre (FR)

(73) Assignee: TDA Armements S.A.S., La Ferte Saint Aubin (FR)

( * ) Notice: Subject to any disclaimer, the term of this patent is extended or adjusted under 35 U.S.C. 154(b) by 604 days.

(21) Appl. No.: 12/374,662

(22) PCT Filed: Jul. 20, 2007

(86) PCT No.: PCT/EP2007/057529

§ 371 (c)(1),
(2), (4) Date: Aug. 21, 2009

(87) PCT Pub. No.: WO2008/009745

PCT Pub. Date: Jan. 24, 2008

(65) Prior Publication Data

US 2009/0308235 A1 Dec. 17, 2009

(30) Foreign Application Priority Data

Jul. 21, 2006 (FR) ..... 06 06696

(51) Int. Cl.
*F42B 33/00* (2006.01)

(52) U.S. Cl. .... 86/50; 102/275.1; 102/275.5; 102/275.6

(58) Field of Classification Search ..... 86/50; 588/403; 102/275.5, 275.6, 275.8, 275.11
See application file for complete search history.

(56) References Cited

U.S. PATENT DOCUMENTS

| | | | | |
|---|---|---|---|---|
| 3,800,715 | A * | 4/1974 | Boller | 109/49.5 |
| 4,055,247 | A * | 10/1977 | Benedick et al. | 206/3 |
| RE36,912 | E * | 10/2000 | Donovan | 110/237 |
| 6,220,166 | B1 | 4/2001 | Cherry | |
| 6,269,725 | B1 * | 8/2001 | Cherry | 86/50 |
| 6,647,851 | B2 * | 11/2003 | Donovan | 86/50 |
| 6,938,533 | B2 * | 9/2005 | Holland et al. | 86/50 |
| 6,979,758 | B2 * | 12/2005 | Eidelman et al. | 588/403 |
| 7,036,418 | B2 * | 5/2006 | Greenfield et al. | 86/50 |
| 7,398,720 | B2 * | 7/2008 | Fujiwara et al. | 86/50 |
| 7,501,551 | B2 * | 3/2009 | Eidelman et al. | 588/403 |
| 7,954,433 | B1 * | 6/2011 | Barnett | 102/307 |
| 2003/0131722 | A1 * | 7/2003 | Donovan | 86/50 |
| 2004/0134335 | A1 * | 7/2004 | Holland et al. | 86/50 |
| 2004/0260141 | A1 * | 12/2004 | Badger et al. | 588/403 |
| 2005/0188825 | A1 * | 9/2005 | Sharpe et al. | 86/50 |
| 2007/0151437 | A1 * | 7/2007 | Fujiwara et al. | 86/50 |
| 2007/0209500 | A1 * | 9/2007 | Wilber | 86/50 |

FOREIGN PATENT DOCUMENTS

| | | | |
|---|---|---|---|
| FR | 2775770 A | | 9/1999 |
| WO | WO-2005/085746 | | 9/2005 |
| WO | WO2005/005121 | * | 10/2005 |

* cited by examiner

*Primary Examiner* — Bret Hayes
*Assistant Examiner* — Joshua Freeman
(74) *Attorney, Agent, or Firm* — Stroock & Stroock & Lavan LLP

(57) ABSTRACT

The invention relates to a pyrotechnic device for the destruction of munitions by an explosive at least partially surrounding the munitions having walls for confining the active products. The device includes an igniter for the controlled ignition of the explosive, the igniter configured to couple explosive detonation waves into the walls of the munitions along at least two opening lines of said walls of the munitions. Application of embodiments of the invention includes controlled destruction of munitions or objects containing pyrotechnic and/or chemical substances.

16 Claims, 5 Drawing Sheets

PYROTECHNIC DEVICE FOR DESTROYING AMMUNITIONS

CROSS-REFERENCE TO RELATED APPLICATIONS

This is a U.S. National Phase application under 35. U.S.C. §371 of International Application No. PCT/EP2007/057529, filed Jul. 20, 2007, and claims benefit of French Patent Application No. 06/06696, filed Jul. 21, 2006, both of which are incorporated herein in their entireties. The International Application was published in French on Jan. 24, 2008 as WO/2008/009745 under PCT 21(2).

FIELD OF THE INVENTION

The invention relates to a pyrotechnic device for the controlled destruction of munitions or objects containing pyrotechnic and/or chemical substances.

BACKGROUND OF THE INVENTION

For example, a chemical munitions usually includes a munitions body (or casing) having metal walls. The inside of the munitions body contains one or more chemicals and a pyrotechnic bursting charge, the role of which is to open the body thereof and to diffuse the chemicals into the atmosphere. The toxic chemical agents of certain munitions are among those known by the name "combat gases" and the action thereof is of the irritating, suffocating, blistering, hemotoxic or neurotoxic type.

The munitions may be in a good state or somewhat damaged depending on their date of manufacture and on their storage conditions. The aim is to destroy these munitions as safely as possible for the personnel and the equipment involved in the destruction, and with the greatest efficiency in destroying the chemicals contained in the munitions.

The munitions may be destroyed by various mechanical, chemical, thermal, pyrotechnic or other methods.

The most common pyrotechnic methods of the prior art use, for destroying the munitions, donor charges such as:

- blocks of plastique;
- hollow charges;
- cutting cords;
- detonating cords;
- explosives surrounding the munitions: the explosive may take various forms, i.e. solid, liquid, pasty, pulverulent or granular forms. In this munitions destruction procedure, the explosive is brought into contact with the munitions and ignited (or detonated) at one point of the explosive.

The munitions destruction devices of the prior art, apart from the cutting cords, require the pyrotechnic and/or chemical substances, internal to the munitions or to the object to be destroyed, to react so as to obtain a significant opening of their body or their casing. They have a limited effectiveness with respect to the destruction of non-explosive chemical substances, except for the blocks of plastique and the explosives surrounding the munitions. Furthermore, the current methods of destruction generate more or less intense effects on the environment (shocks, blast, pollution, heat and fragments), depending on the architecture and the explosive of the donor charge and on the reaction of the munitions or the object to be destroyed.

Other methods of the prior art for destroying munitions consist in dismantling the munitions into its components and in collecting the chemical and pyrotechnic substances in suitable containers in order to destroy them subsequently, for example by neutralization or incineration in special furnaces.

The drawback of such a method is that it includes many delicate operations carried out on the munitions with risks for the personnel in the various steps of the method, which risks are aggravated when the munitions are in a poor state. It is frequently so after long storage under poor conditions.

Another drawback of said method is the long time needed to destroy the munitions.

The destruction device claimed in the present patent enables the various drawbacks of the destruction methods most commonly used to be alleviated.

SUMMARY OF THE INVENTION

For this purpose, embodiments of the invention provides a pyrotechnic device for the destruction of munitions by an explosive at least partially surrounding the munitions having walls for the confinement of active products, characterized in that it includes means for the controlled ignition of the explosive, these means being configured to couple explosive detonation waves into the walls of the munitions along at least two opening lines of said walls of the munitions.

The term "active products" is understood to mean pyrotechnic, chemical or other substances that may be contained by the munitions.

Advantageously, the controlled ignition means include at least two pyrotechnic ignition cords for igniting the explosive, each of the cords having a start-of-ignition end $E_s$ and an end-of-ignition end $E_e$, the start-of-ignition ends of the cords being connected by at least one firing means.

Initiating the ignition cords, by known firing means, causes the ignition of the cords to propagate from their start-of-ignition end to their other, end-of-ignition, end with a predetermined propagation rate.

In one embodiment of the device intended for the destruction of munitions having a shape approximating a cylinder with an axis of revolution XX', or objects provided with a casing of any other shape, the controlled ignition means include two ignition cords which are in contact with or close to the explosive in order to initiate the explosion, on either side of the XX' axis of the munitions, and are aligned along an opening line of the walls of the munitions.

In another embodiment of the device, intended for the destruction of munitions having a shape approximating a cylinder having an axis of revolution XX', or objects provided with a casing of any other shape, the controlled ignition means include two pairs P1, P2 of ignition cords.

The firing means include, for example, a detonator for initiating the ignition cords via their start-of-ignition ends $E_s$ in order to cause controlled detonation of the explosive along the opening lines of the munitions.

A main objective of the destruction device according to embodiments of the invention includes obtaining a controlled opening of the walls of the munitions, or of objects, without counting on the reaction of the internal substances of the munitions.

Another objective is to control the fragmentation of the munitions body and thus reduce the effects of the emitted fragments on the environment external to the destruction device.

Another objective is the destruction of the pyrotechnic and/or chemical substances of the munitions.

The expression "destruction of the munitions" should be understood in the device according to embodiments of the invention to mean the destruction of the containers and of the contents, i.e. notably the opening of the munitions casings, the destruction of the pyrotechnic bursting charge and the destruction of the chemical agent charge.

BRIEF DESCRIPTION OF DRAWINGS

The invention will be more clearly understood with the aid of exemplary embodiments of the destruction device according to the indexed drawings in which.

DETAILED DESCRIPTION OF EMBODIMENTS

Figure 1A:
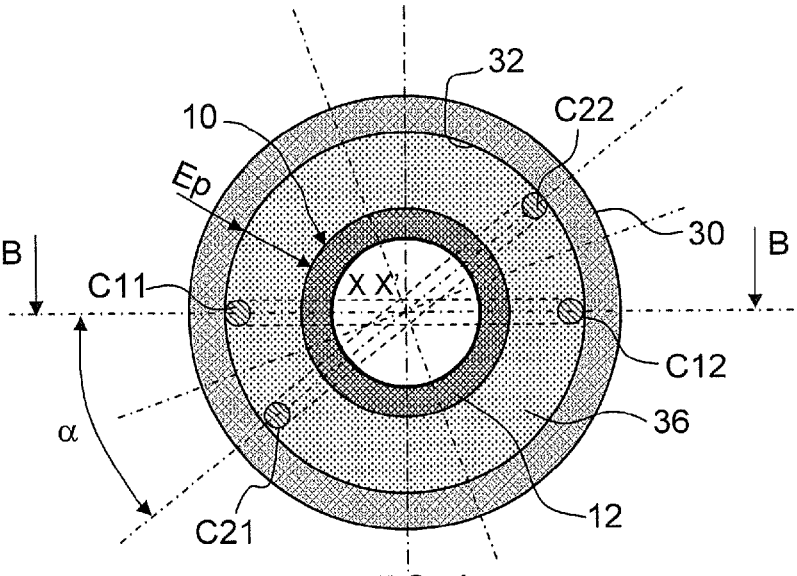
FIGS. 1*a* and 1*b* show an exemplary embodiment of a munition destruction device according to the invention.
Figure 1B:
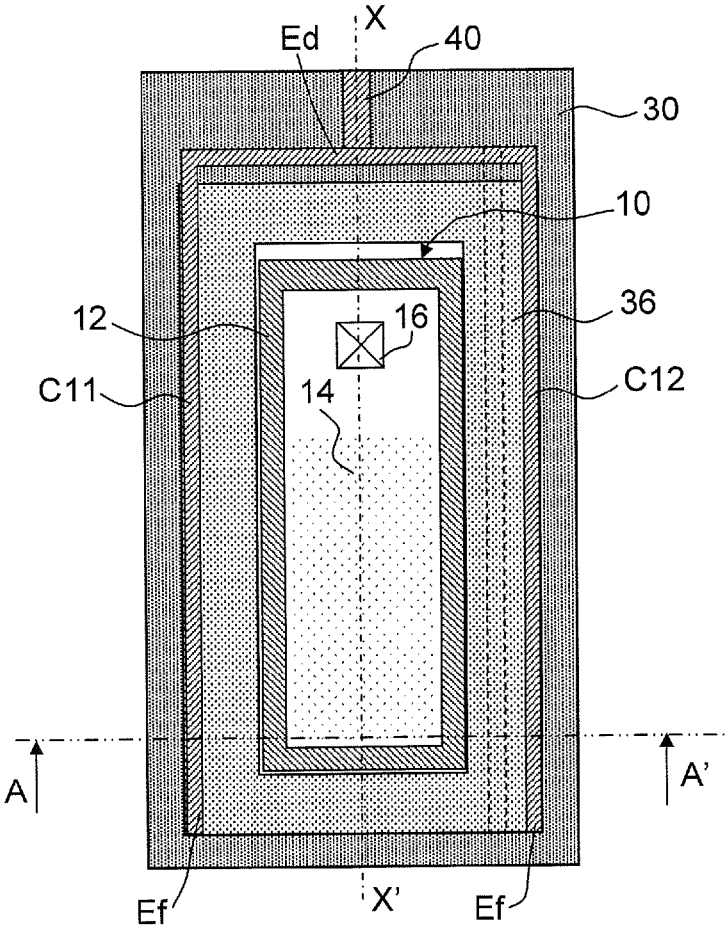

FIGS. 1*a* and 1*b* show an exemplary embodiment of a munitions destruction device according to the invention.

FIG. 1*a* shows a bottom view along AA' of the device of FIG. 1*b*, comprising a chemical munitions 10 to be destroyed, and FIG. 1*b* shows a cross-sectional view along BB' of the device of FIG. 1*a*.

The chemical munitions 10 includes, in this example, a metal wall 12 of cylindrical shape containing a chemical product 14 and a pyrotechnic bursting charge 16.

The destruction device of FIGS. 1*a* and 1*b* is of cylindrical shape with an axis of revolution XX' and includes:

- a cylindrical container 30 having internal walls 32 defining a volume comprising a donor (explosive) charge 36, the explosive 36 being between the internal walls 32 of the container 30 and the munitions 10 to be destroyed; and
- two pairs P1, P2 of ignition cords C11, C21 in respect of the first pair P1 and C12, C22 in respect of the second pair P2 between the internal walls 32 of the cylindrical container 30 and the explosive 36, or in the container.

The ignition cords C11, C12, C21, C22 each have a start-of-ignition end $E_s$ and an end-of-ignition end $E_e$ and are configured in the device so that the cords C11, C21 of the pair P1 and the cords C12, C22 of the pair P2 are separated by a predetermined angular distance $\alpha$.

The angular distance $\alpha$ between the cords of the two pairs P1, P2 and the thickness Ep of explosive 36 are predetermined so as to obtain localized overpressures by coupling detonation waves of the explosive into the walls 12 of the munitions, which waves are powerful enough to break said wall.

In this exemplary embodiment, the cords C11, C12, C21, C22 are approximately parallel to the generatrix of the cylindrical internal walls 32 of the cylindrical container 30.

The cylindrical container 30 further includes an initiating detonator 40 connected to the start-of-ignition ends $E_s$ of the ignition cords C11, C12, C21, C22.

We will explain below the operation of embodiments of the destruction device according to the invention.

The initiating detonator 40 (see FIG. 1*b*) is fired, causing the simultaneous ignition at a time t in the four ignition cords C11, C12, C21, C22. The ignition of the cords via their respective start-of-ignition ends $E_s$ propagates right to the end-of-ignition ends $E_e$ with a propagation rate determined by the characteristics of the cords.

The ignition of the cords causes detonation of the explosive 36, propagating along the propagation lines corresponding to the lines of the cords parallel to the XX' axis of the munitions.

Figure 2:
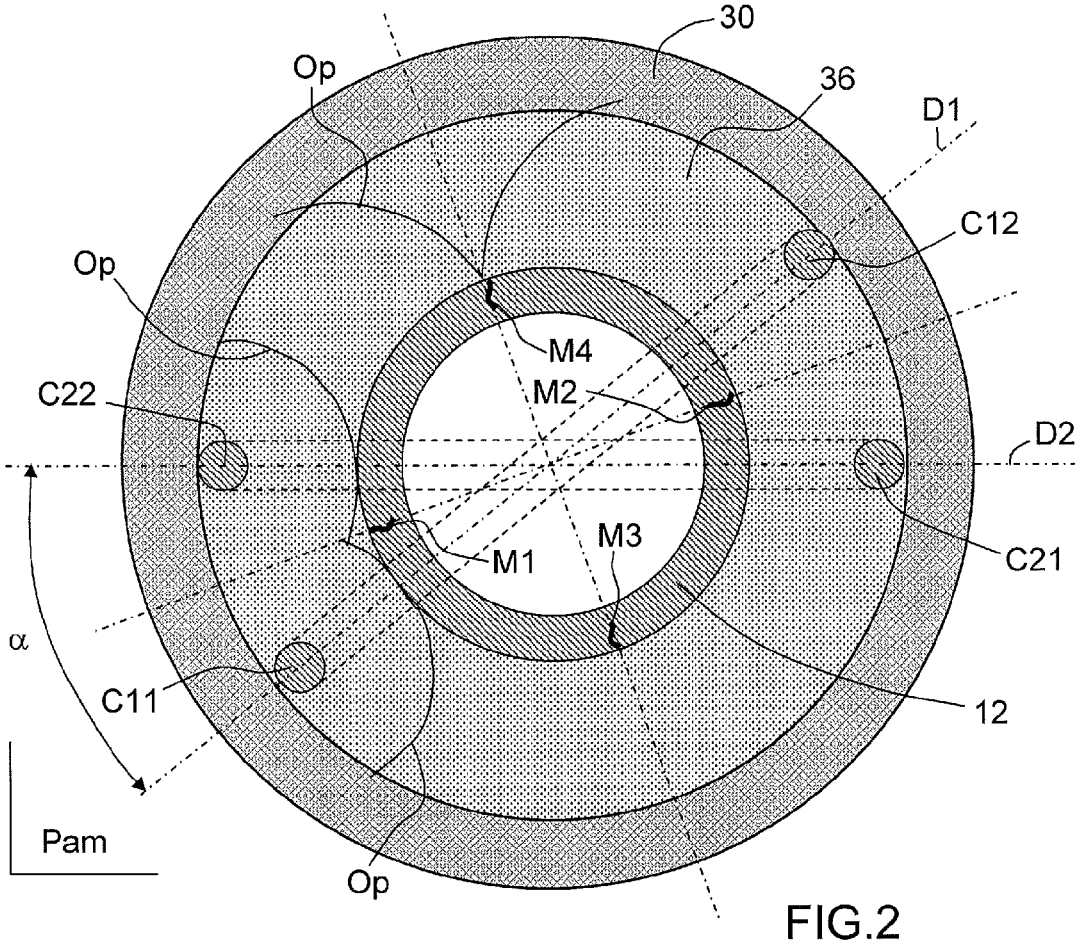
FIG. 2 shows an enlarged view on AA' of FIG. 1*b*, showing the coupling of pressure waves.

FIG. 2 shows an enlarged view on AA' of FIG. 1*b*, showing the coupling of the pressure waves Op of the detonation into the wall 12 of the munitions, in a plane Pam perpendicular to the propagation axis of the explosion.

The simultaneous detonation of the explosive in the four ignition cords C11, C12, C21, C22 in the plane Pam perpendicular to the detonation propagation axis produces convergent Mach wave encounters in zones M1, M2 and then convergent wave encounters in zones M3 and M4 of the walls 12 of the munitions, the convergence zone M1 being on the wall 12 between the cords C11 and C22, the convergence zone M2 being between the cords C12 and C21, the convergence zone M3 being between the cords C11 and C21 and the convergence zone M4 being between the cords C12 and C22.

The convergence in the zones M1, M2, M3, M4 of the wall of the munitions of the explosive detonation waves generates localized overpressures that propagate along the wall 12 of the munitions, from a start-of-ignition zone to an end-of-ignition zone of the explosive, along the cord lines, causing the wall of the munitions to rupture and therefore open along these four propagation lines.

Figure 3:
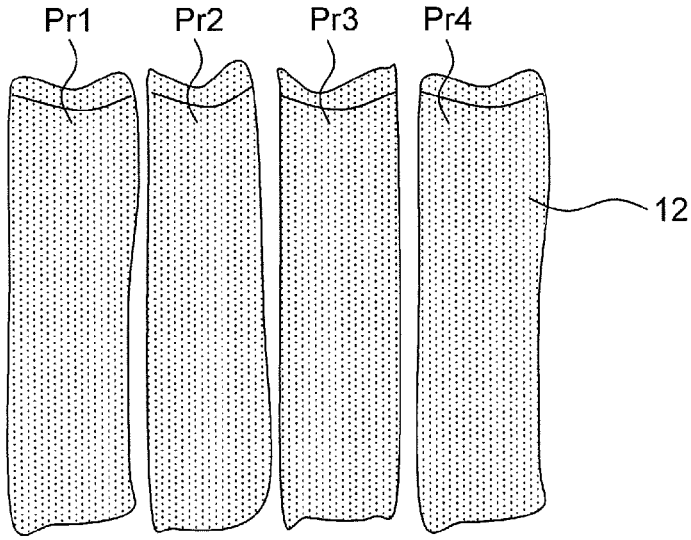
FIG. 3 shows, after explosion, the wall of the munition of FIG. 1*b* opened into four portions.

FIG. 3 shows, after the explosion, the wall 12 of the munitions of FIG. 1*b* opened into four portions Pr1, Pr2, Pr3 and Pr4, the edges of which correspond to the four rupture lines created by the controlled explosion of the cords.

The explosion also produces, according to another important feature of embodiments of the invention, destruction of the chemical and pyrotechnic products contained in the munitions. For this purpose, the explosive may be based on aluminum, which produces, upon its detonation, a fireball of long duration for the purpose of destroying the chemical products, notably those contained in the munitions which is opened by the controlled explosion.

To give an example, in one particular embodiment of a device for the destruction of munitions with a diameter of less than 80 millimeters, the thickness Ep of the explosive, of the explosive water-in-oil emulsion type, is around 20 millimeters and the cylindrical container is made of PVC or cardboard. The ignition propagation rate of the ignition cords is around 7000 m/s and that of the explosive around 5500 m/s. The angle $\alpha$ between the cords C11 and C22 and between the cords C12 and C21 is between 35° and 45°.

Figure 4A:
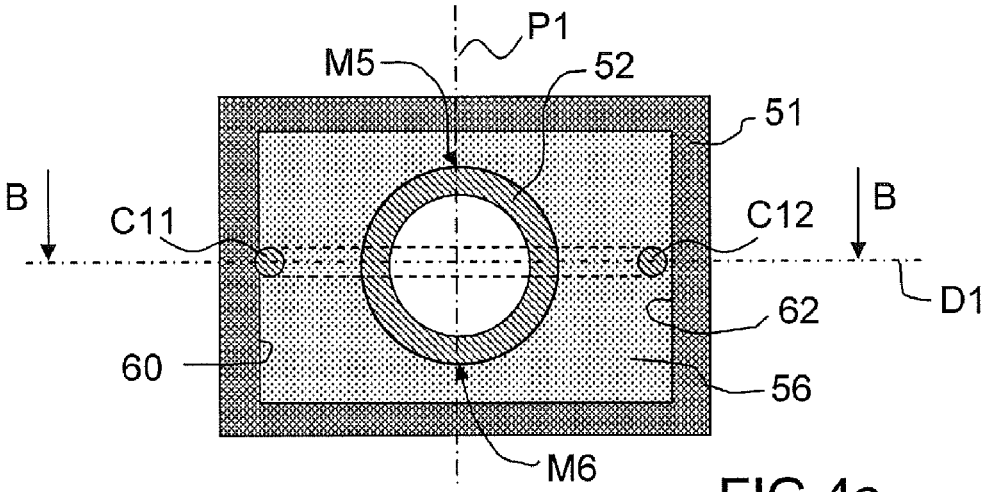
FIGS. 4*a* and 4*b* show a variant embodiment of the munition destruction device according to the invention.
Figure 4B:
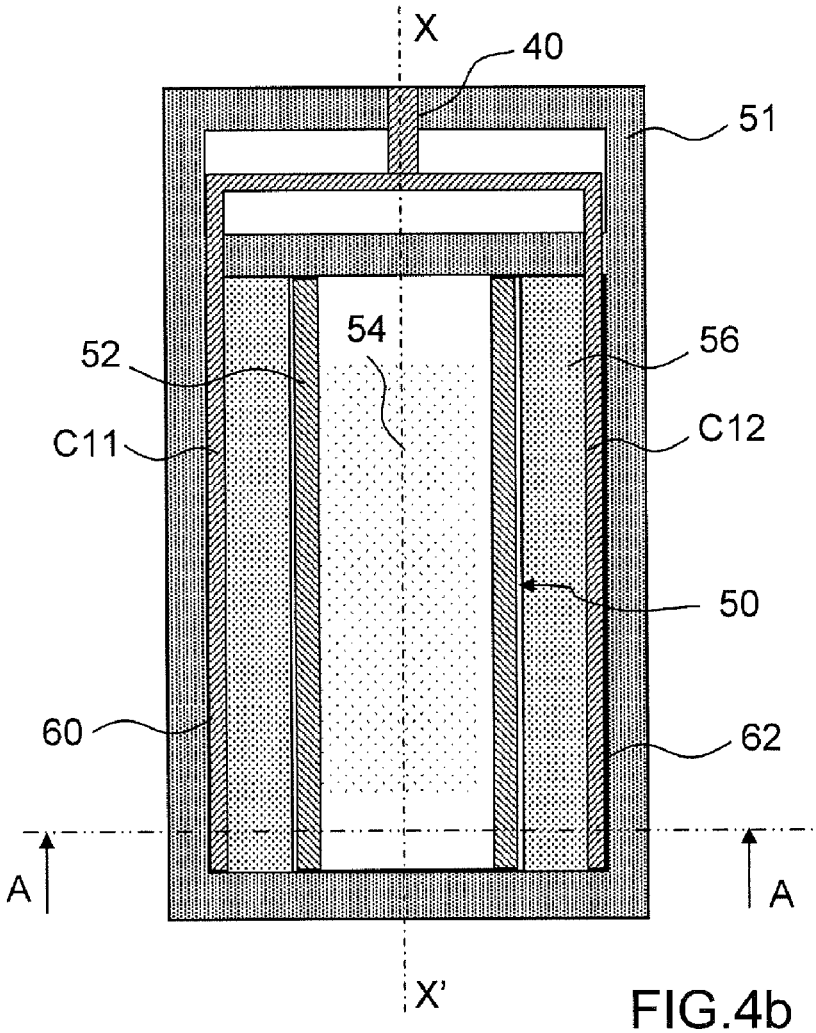

FIGS. 4*a* and 4*b* show a variant embodiment of the device for the destruction of a munitions 50 according to the invention comprising a parallelepipedal container 51. The munitions 50 has a cylindrical metal wall 52 along the XX' axis and contains a chemical product 54.

In this embodiment shown in FIG. 4*a*, the container 51 is a box of rectangular cross section, for example made of wood or cardboard or plastic (or any material generating few fragments), containing an explosive 56 surrounding the munitions to be destroyed and filling the box.

The device includes the two cords C11 and C12 for igniting the explosive 56 on either side of the munitions 50 in a plane D1 passing through the XX' axis and close to two opposed internal walls 60, 62 of the box.

In this embodiment, the overpressure waves are produced in zones M5, M6 along lines of the wall 52 of the munitions 50 in a plane P1 perpendicular to the plane D1 of the ignition cords C11, C12.

Figure 5:
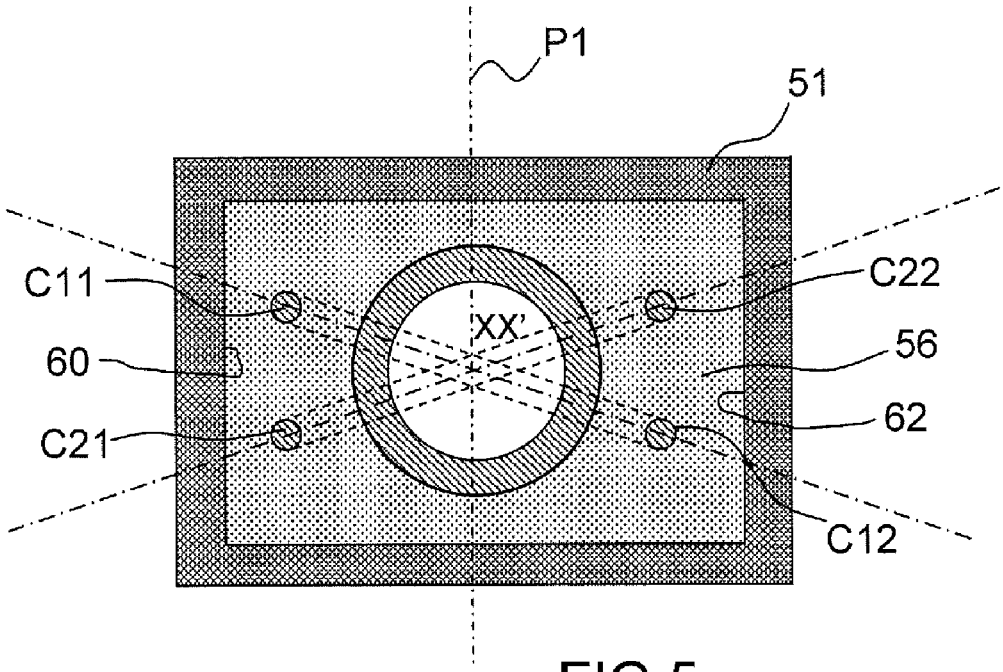
FIG. 5 shows a variant embodiment of FIG. 4*b;*

FIG. 5 shows a variant embodiment of FIG. 4*a*, having an ignition device comprising the two pairs P1, P2 of cords (embodiment shown in FIG. 1*b*).

Figure 6:
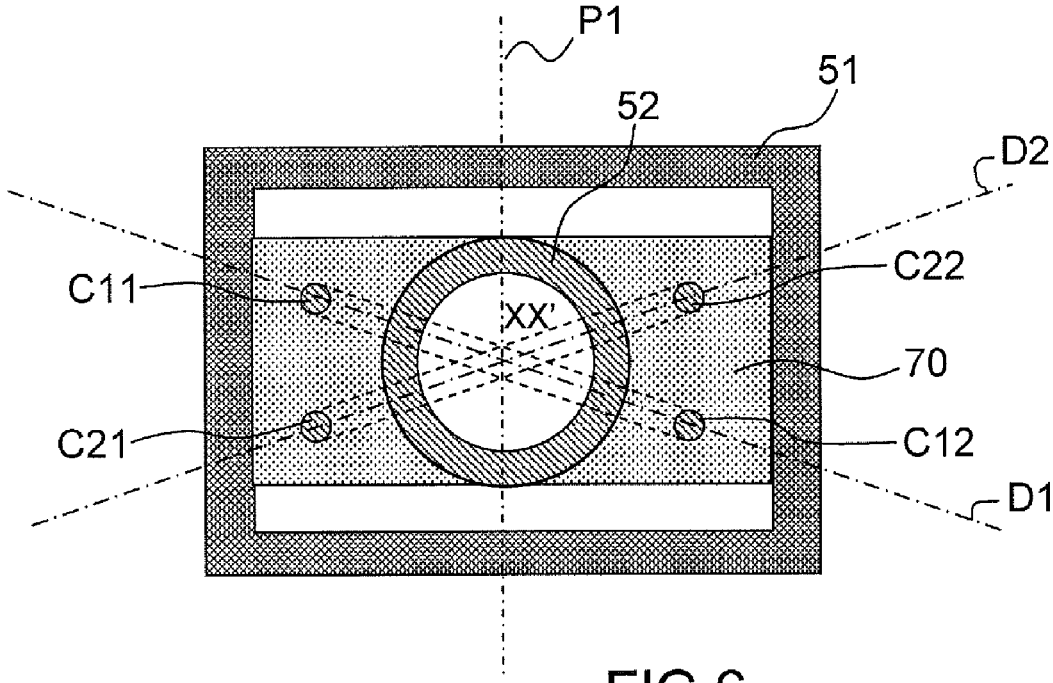
FIG. 6 shows a more economical variant embodiment of FIG. 5.
Figure 7A:
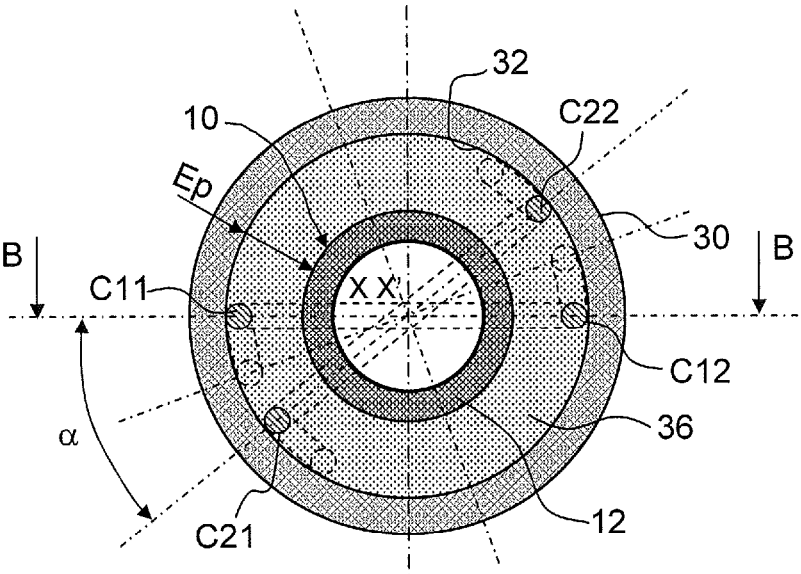
FIGS. 7*a* and 7*b* show another exemplary embodiment of a munition destruction device.
Figure 7B:
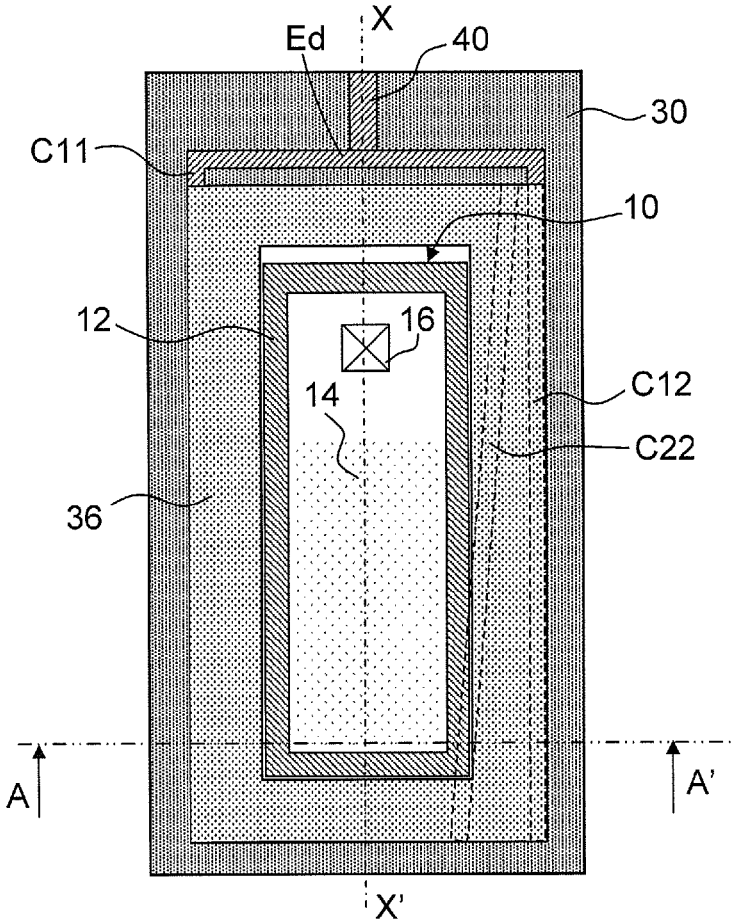

FIG. 6 shows a more economical variant embodiment of FIG. 5, comprising the two pairs P1, P2 of ignition cords. In this other variant of FIG. 6, an explosive 70 partially fills the box 51 partially surrounding the munitions.

The above descriptions are not limiting and, in other embodiments of the device according to the invention, the cords for igniting the explosive surrounding the munitions to be opened may follow lines of various nonrectilinear forms. For example, lines wind around the wall of the munitions, from one end of the munitions to the other, so as to obtain an opening of helicoidal shape.

The pyrotechnic device according to embodiments of the invention makes it possible to destroy a very wide range of munitions or objects containing pyrotechnic and/or chemical substances by virtue of its capability of:

- opening munitions bodies or casings of objects to be destroyed without counting on the reaction of their internal substances (inert substances or active substances which have become inert over the course of time);
- opening munitions or objects whereby the thicknesses of the bodies or casings thereof are very variable, ranging from a few millimeters to several centimeters;
- opening munitions or objects, the mechanical properties of the bodies or casings of which are very variable (e.g. very brittle or very ductile material);
- opening munitions or objects, the shapes of which are very varied; and
- destroying most of the internal substances, notably the chemical products, by the effects of a long-lasting active fireball.

Furthermore, the pyrotechnic destruction device according to embodiments of the invention makes it possible to control the fragmentation of the body of the munitions or of the casing of the object to be destroyed and consequently the effects of the emitted fragments on the external environment.

The invention claimed is:

1. A pyrotechnic device for the destruction of munitions by an explosive at least partially surrounding the munitions, the munitions having a longitudinal axis and walls that extend along the longitudinal axis for the confinement of active products, the pyrotechnic device comprising:

an igniter to produce a controlled ignition of the explosive, the igniter comprising at least two ignition cords for igniting the explosive, each of the ignition cords extending along the longitudinal axis in contact with or adjacent to the explosive to detonate the explosive and couple resultant explosive detonation waves into the walls of the munitions along at least two opening lines of said walls of the munitions.

2. The pyrotechnic device as claimed in claim 1, wherein each of the ignition cords has a start-of-ignition end $E_s$ and an end-of-ignition end $E_e$, the start-of-ignition ends of the cords being connected by at least one firing device.

3. The pyrotechnic device as claimed in claim 1, wherein the at least two ignition cords are disposed on opposing sides of the longitudinal axis.

4. The pyrotechnic device as claimed in claim 1, wherein the igniter comprises two pairs of ignition cords.

5. The pyrotechnic device as claimed in claim 2, wherein the firing device comprises a detonator to ignite the pyrotechnic ignition cords via their respective start-of-ignition ends in order to cause controlled detonation of the explosive along the opening line of the munitions.

6. The pyrotechnic device as claimed in claim 3, comprising:

a cylindrical container having internal walls defining a volume to enclose a donor explosive charge, the donor explosive charge located between the internal walls of the container and the munitions to be destroyed; and a first and second pair of ignition cords respectively between the internal walls of the cylindrical container and the explosive, or in the container, the first pair of ignition cords comprising first and second ignition cords respectively disposed on opposing sides of the longitudinal axis, and the second pair of ignition cords comprising third and fourth ignition cords respectively disposed on opposing sides of the longitudinal axis.

7. The pyrotechnic device as claimed in claim 6, wherein the first, second, third and fourth ignition cords are configured so that the first and second ignition cords of the first pair and the third and fourth cords of the second pair are separated by a predetermined angular distance.

8. The pyrotechnic device as claimed in claim 7, wherein the angular distance between the respective cords of the two pairs and a thickness of explosive are predetermined to provide localized overpressures by coupling detonation waves of the explosive into the walls of the munitions.

9. The pyrotechnic device as claimed in claim 8, wherein a simultaneous detonation of the four ignition cords in a plane perpendicular to the detonation propagation axis produces convergent Mach wave encountered in first and second predetermined convergence zones of the walls of the munitions, and then convergent waves encountered in third and fourth predetermined convergence zones of the walls of the munitions, the first convergence zone being on the wall of the munitions between the first and fourth ignition cords, the second convergence zone being between the second and third ignition cords, the third convergence zone being between the first and third ignition cords, and the fourth convergence zone being between the second and fourth ignition cords.

10. The pyrotechnic device as claimed in claim 8, wherein the angle between the first pair of cords and second pair of cords is between 35° and 45°.

11. The pyrotechnic device as claimed in claim 1, comprising a box of rectangular cross section containing the explosive surrounding the munitions to be destroyed wherein the box includes first and second ignition cords for igniting the explosive on either side of the munitions in a plane passing through the longitudinal axis of the munitions and adjacent to two opposed internal walls of the box.

12. The pyrotechnic device as claimed in claim 11, wherein an explosive partially fills the box partially surrounding the munitions.

13. The pyrotechnic device as claimed in claim 2, wherein the pyrotechnic ignition cords follow lines of various nonrectilinear shapes.

14. The pyrotechnic device as claimed in claim 13, wherein the lines wind around the wall of the munitions, from a first end of the munitions to a second end of the munitions, so as to obtain an opening of helicoidal shape.

15. The pyrotechnic device, as claimed in claim 4, wherein the firing device comprises a detonator to ignite the pyrotechnic ignition cords via their respective start-of-ignition ends in order to cause controlled detonation of the explosive along the opening line of the munitions.

16. The pyrotechnic device as claimed in claim 11, further comprising third and fourth ignition cords for igniting the explosive on either side of the munitions in the plane passing through the longitudinal axis of the munitions and adjacent to the two opposed internal walls of the box, the third and fourth ignition cords disposed on opposing sides of the longitudinal axis and at a predetermined angle with respect to the first and second ignition cords.

* * * * *